United States Patent [19]

Buccicone

[11] 4,130,206

[45] Dec. 19, 1978

[54] SHEET PILING MACHINE WITH CLASSIFIER AND MULTIPLE PILING ARRANGEMENTS

[75] Inventor: Velio S. Buccicone, Portage, Ind.

[73] Assignee: Bucciconi Engineering Co., Inc., Gary, Ind.

[21] Appl. No.: 729,131

[22] Filed: Oct. 4, 1976

[51] Int. Cl.[2] ..... B65G 57/11

[52] U.S. Cl. ..... 214/6 D; 271/223; 271/224

[58] Field of Search ..... 214/6 D, 6 DS, 6 S; 271/64, 223, 224, 214, 240

[56] References Cited

U.S. PATENT DOCUMENTS

| | | | |
|---|---|---|---|
| 1,685,873 | 10/1928 | Evans et al. | 271/223 |
| 3,406,841 | 10/1968 | Smith | 271/224 |
| 3,907,128 | 9/1975 | Cathers | 271/224 |
| 3,942,784 | 3/1976 | Buccione | 214/6 DS |

*Primary Examiner*—Drayton E. Hoffman
*Assistant Examiner*—Ross Weaver
*Attorney, Agent, or Firm*—Guy A. Greenawalt

[57] ABSTRACT

A machine for piling metal sheets in dual piling areas in which are positioned pile accumulating mechanisms having sheet end stop and side edge guide mechanisms, which machine includes an infeed conveyor positioned to normally deliver sheets fed thereto into the first pile accumulating mechanism and an overhead magnetic conveyor overlying the discharge end of the infeed conveyor which may be activated to lift selected sheets from the infeed conveyor and deliver them onto an associated conveyor which serves to feed sheets to a second pile accumulating mechanism and which is supported in cantilevered arrangement on the supporting frame of the second pile accumulating mechanism and extends rearwardly thereof and above the first pile accumulating mechanism.

12 Claims, 15 Drawing Figures

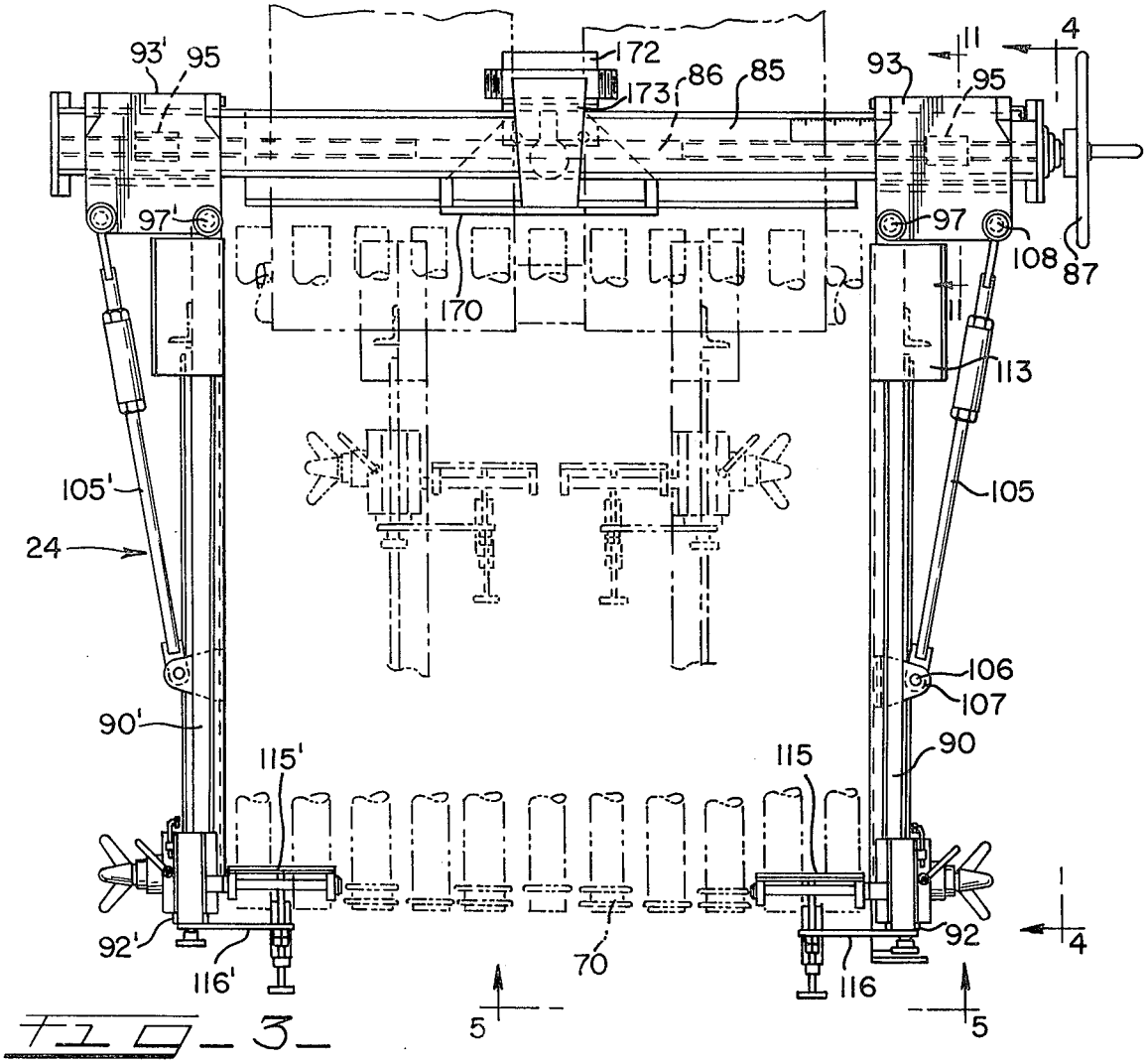
FIG. 3
FIG. 4
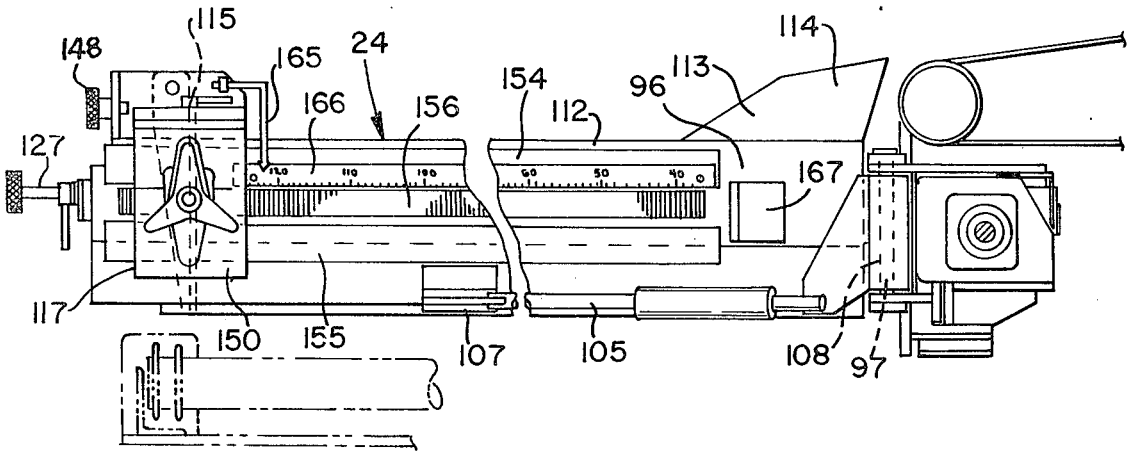

SHEET PILING MACHINE WITH CLASSIFIER AND MULTIPLE PILING ARRANGEMENTS

BACKGROUND OF THE INVENTION

This invention relates to equipment for handling sheet materials, such as, metal sheets which are delivered to the equipment by shearing mechanism in a rolling mill web or strip fabricating operation, or from another supply source, and is more particularly concerned with improvements in a machine which enables an operator to pile the sheets in single or multiple areas.

In rolling mill metal fabricating operations where the finished product coming off the mill rolls is a relatively long metal strip, or web, which is cut into sections to form sheets of the desired length and/or configuration, it is generally desirable to pile the metal sheets on pallets for removal from the line or for supplying further equipment performing other processing operations. Various types of apparatus for receiving the cut or sheared off sheets have been developed and used with varying degrees of success. Where the sheets are cut or sheared to uniform length and rectangular configuration, the piling operation may be accomplished by single pile forming machines of several designs some of which may include sheet lapping arrangements designed to accommodate high speed rolling operations without requiring excessive speed for the piling machine conveyor or conveyors, that is, a speed which will result in attendant wear and control problems and risk of damage to the sheets. Also, machines have been provided for piling sheets which have been cut in odd sizes and cannot be conveniently piled in single piling areas, so that, the need arises, for example, to provide a piling machine which will pile alternate sheets in two separate piles. One such machine which will accomplish satisfactory dual piling of odd shaped sheets, such as those delivered from an oscillating shear in a web or strip fabricating line, is disclosed in U.S. Pat. No. 3,055,659, granted Sept. 25, 1962 to Dario Buccicone. In that machine and others of a similar character, special conveyor arrangements are provided for receiving the sheets from the shear and for conveying them to an overhead magnetic conveyor which is of a length to extend over one or more piling areas and which has associated end stop and side guide mechanisms at each piling area for arresting the advance of the sheets and guiding them into a pile on a pile accommodating or accumulating lift structure from which the pile of sheets may be readily removed. Another metal sheet piling machine of this type is disclosed in U.S. Pat. No. 3,369,675, granted Feb. 20, 1968, to Dario Buccicone, which employs an overhead magnetic conveyor mounted on upright end frames so as to span dual piling areas in which are mounted scissors-type lift mechanisms carrying pile accommodating platforms, with the latter being driven by power operated vertical screws disposed in upright frames forming part of the end frames. In this machine, sheet end stop and side guide mechanisms are mounted on overhead framing extending, along with the overhead magnetic conveyor, between vertical support frames at opposite ends of the machine.

In these and other magnetic piling machines the advance and deposit of the sheets in the piling area is controlled by operation of the magnets in the conveyor which extends over the piling box. The sheets may be released by the magnetic conveyor so as to drop evenly onto the pile in an almost vertical path and the risk of damage to the preceeding sheet by scratching or gouging contact with the edges of the falling sheet is reduced to a minimum. These machines will operate with a high degree of efficiency to pile sheets in a single pile or double pile arrangement. However, they require relatively precise positioning of the magnets in the overhead conveyor and also control arrangements for operating the magnets. These and other factors greatly increase the cost of fabrication and operation of the machines. In addition these machines are normally built for piling in a relatively small number of areas due to practical limitations, particularly with respect to the length of the overhead magnetic conveyor. While a number of these machines may be placed in line and sheets transferred or advanced to the respective piling areas by suitable conveyors such multiple piling arrangements generally increase the cost of the equipment and its operation to an undesirable extent, particularly, when precise piling and maximum care in the handling or treatment of the sheets is not a requirement.

A lift mechanism or hoist of the scissors-type which is adapted for use in the foregoing and other sheet piling operations of a similar character is disclosed, also, in my U.S. Pat. No. 3,727,780, granted Apr. 17, 1973, in which the lift platform is raised and lowered by operation of a single power driven screw mounted in a vertically disposed portion of the frame structure which supports the lift platform and guides it in its vertical path.

Experience with the apparatus previously employed for multiple piling of metal sheet products, with or without classifying capability, has indicated a need for apparatus for such purpose which is more versatile in use and at the same time is more economical to construct and operate. Accordingly, it is a general object of the present invention to provide an improved metal sheet piling apparatus which is capable of ready extension by addition of piling units so as to provide for multiple piles, which has classifying capability and which may be constructed with greater economy than apparatus heretofore employed for similar purposes.

A more specific object of the invention is to provide a piling machine for metal sheets which may be economically constructed and which may be readily extended to increase the number of separate piling areas in a simple and convenient manner.

A further object of the invention is to provide a pile forming machine for handling metal sheets which are supplied from a sheet rolling mill line, or the like, wherein the machine may be readily adjusted for a desired number of piles by adding or subtracting pile forming units, of relatively economical construction, with associated classifying mechanism, and enabling sheets having differing configuration or other characteristics to be directed into the desired number of different piles.

A still further object of the invention is to provide a metal sheet piling machine or apparatus having one or more piling areas wherein a pile supporting platform or hoist mechanism together with a mechanism for arresting the forward travel of the sheets and for guiding the arrested sheets into a pile on the platform is mounted on a common support frame and disposed in each of the respective piling areas.

Apparatus capable of achieving these and other objects and advantages is disclosed and claimed herein which is characterized by means for accumulating sheets in a pile, in one or more piling areas, on a pile receiving means which is mounted on a support frame having a vertically disposed portion for guiding the pile receiving means in a vertical path as it is moved in such path by associated drive means and the sheets are deposited thereon, and associated mechanism mounted on the support frame for arresting the forward movement of the sheets and for guiding the sheets into pile forming relation on the pile receiving means.

The invention will be best understood by reference to the following description of a preferred embodiment of a piling machine which incorporates therein the principle features of the invention and which is illustrated in the accompanying drawings wherein the same elements are identified in the several views by the same numerals.

In the drawings:

FIG. 3 is a plan view to an enlarged scale, showing the pile accumulating mechanism including back stop, end stop and side guide mechanism which is mounted along with the sheet supporting hoist or lift platform on a supporting frame structure at the first piling area, with portions of the sheet supporting rollers on the lift platform being shown in phantom line;

FIG. 4 is a side elevational view with portions broken away, showing one side of the sheet guiding mechanism of FIG. 3 and a portion of the associated lift platform, the latter being shown in phantom line;

Figure 1:
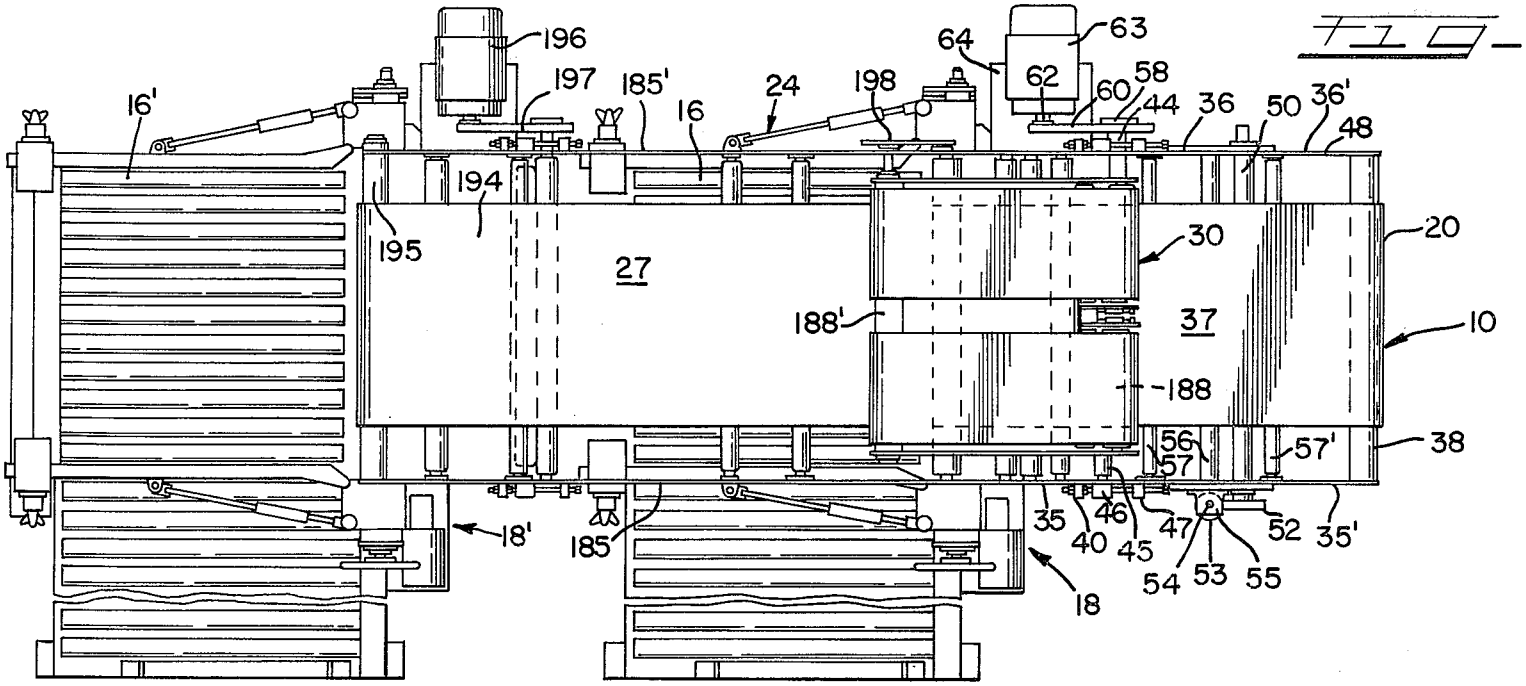
FIG. 1 is a plan view, with parts omitted or shown schematically, of an apparatus for classifying and piling in multiple piles metal sheets which are fed to the apparatus from a sheet fabricating line, or other supply source, with associated pile discharge, or take away, conveyors disposed along one side of the piling areas.
Figure 2:
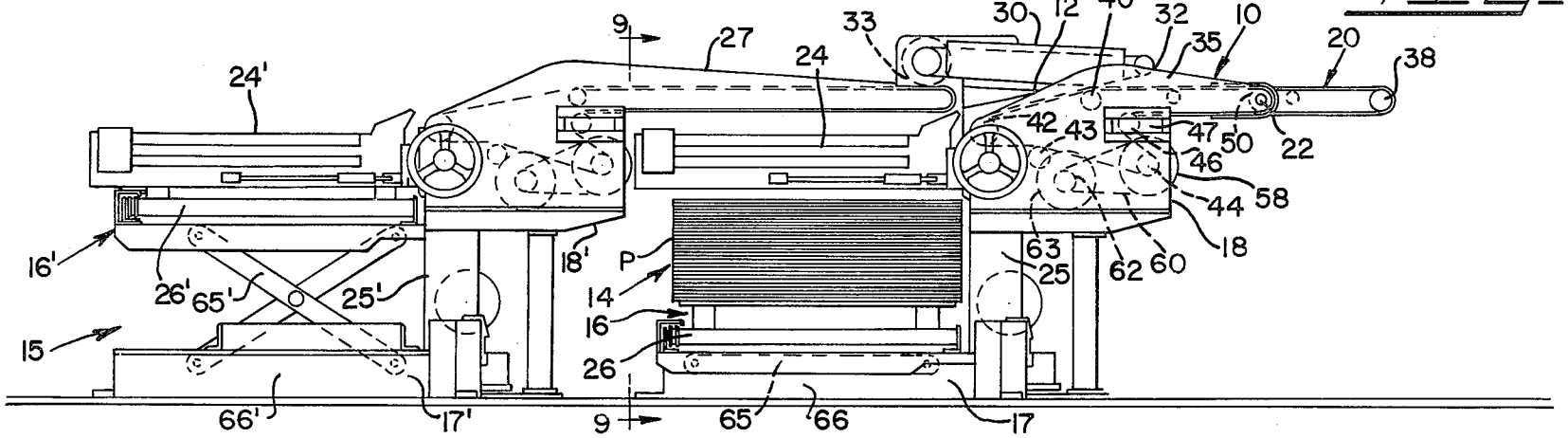
FIG. 2 is a side elevation of the apparatus of FIG. 1 with the pile discharge conveyors omitted.
Figures 5, 12:
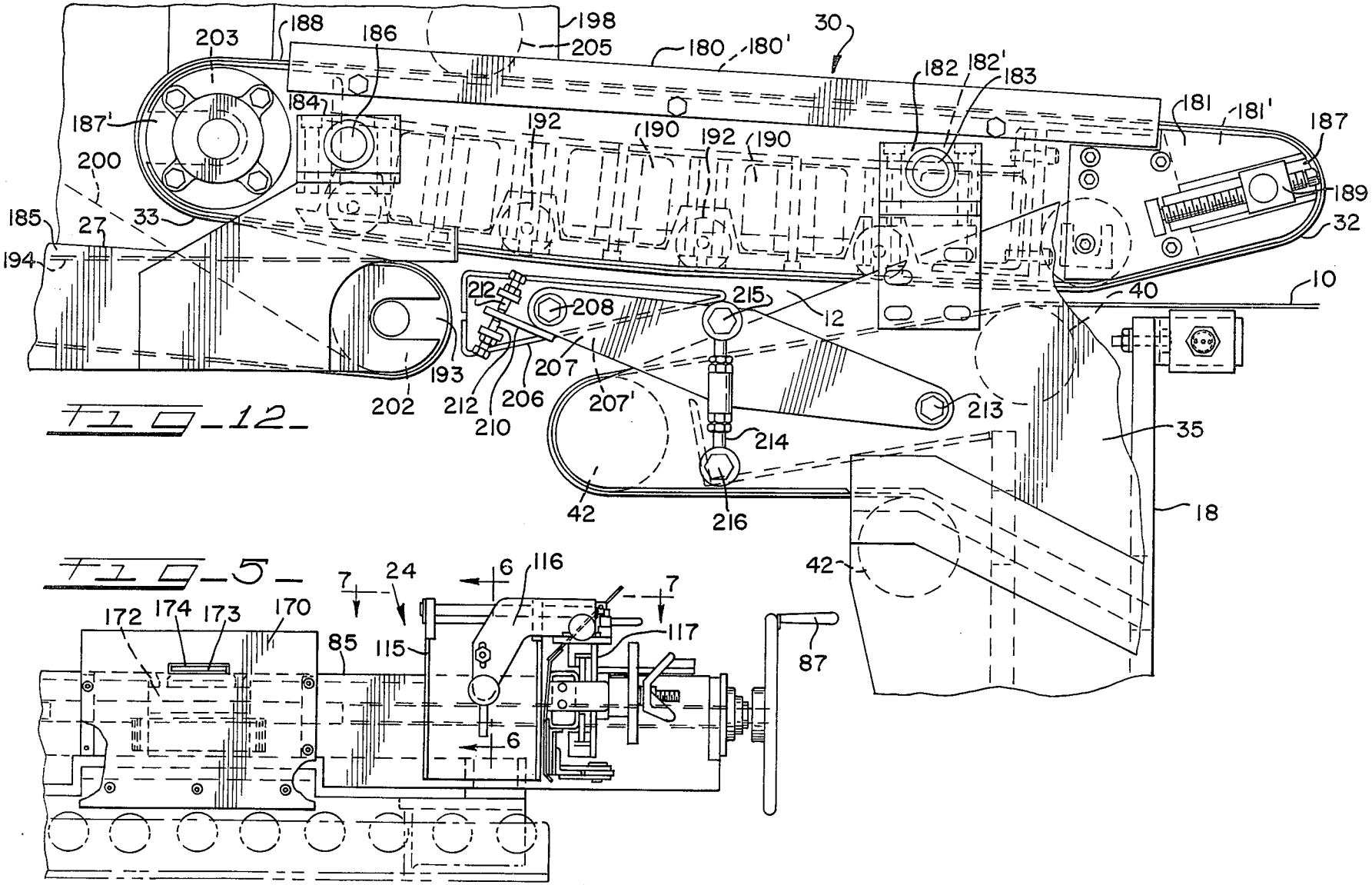
FIG. 5 is a partial elevational view, to a larger scale, which is taken on the line 5—5 of FIG. 3.
FIG. 12 is a partial side elevational view, to an enlarged scale, showing the overhead classifying conveyor and associated mechanism at the entrance end of the first piling area.
Figure 9:
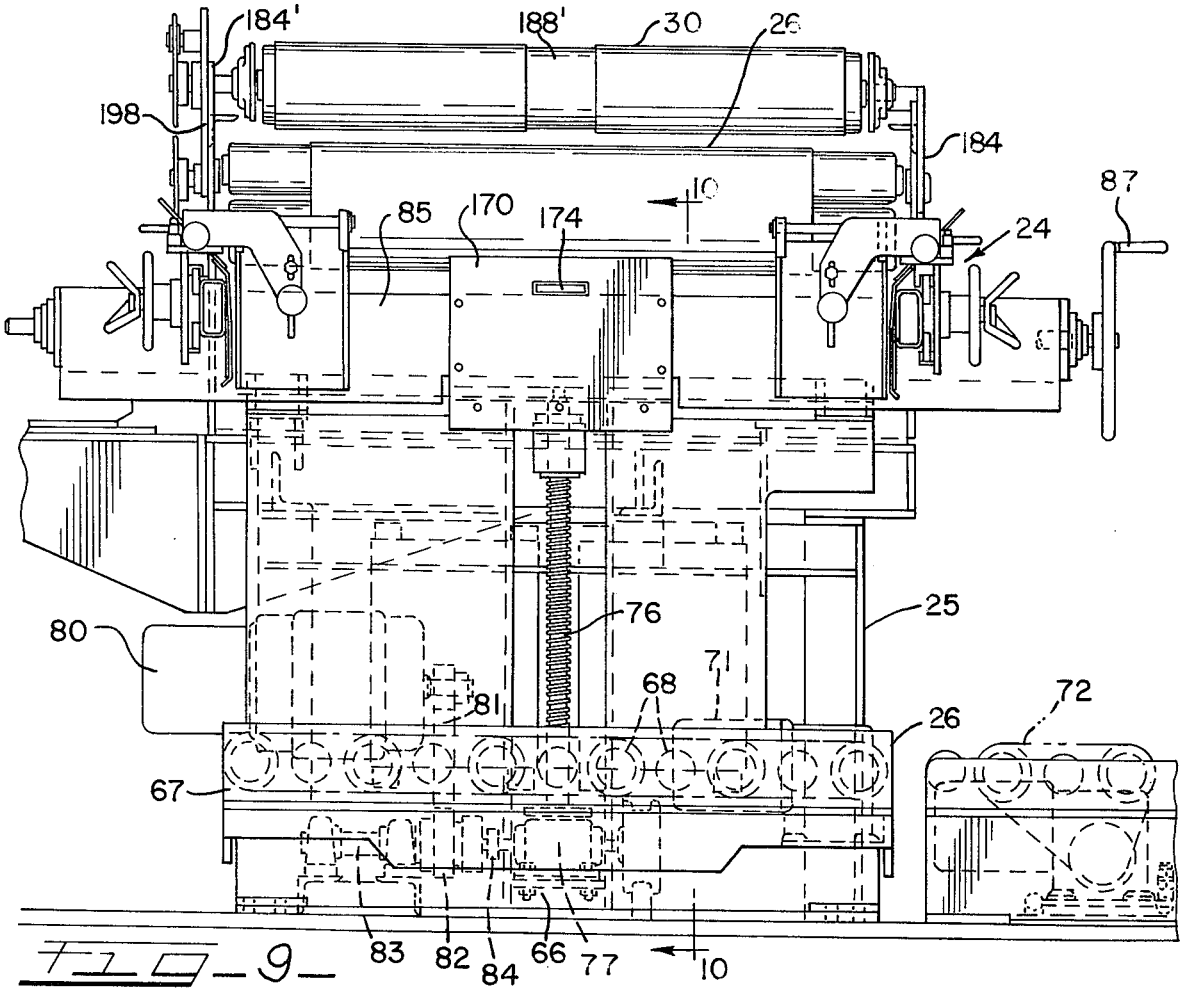
FIG. 9 is an elevational view which is taken on the line 9—9 of FIG. 2, to a larger scale and with portions omitted.

Referring particularly to FIGS. 1, 2 and 9, there is shown by way of illustration, a metal sheet piling apparatus or machine in which there are incorporated the principle features of the invention. While the illustrated machine is especially adapted to accept sheets from a shear in a plate making mill or line and to pile the sheets in a single pile or in two different piles, at the will of the operator, it will be understood that the machine may be provided with further generally duplicate pile forming units which will enable piling in more than two piling areas. In the machine illustrated, the metal sheets are fed from a shear or other supply source and they may be odd-shaped, that is, non-rectangular, such as shown, for example, in U.S. Pat. No. 3,055,659.

In the machine which is illustrated, the sheets are delivered from a supply source to an infeed conveyor assembly 10 and advanced to a classifying area 12 adjacent the entrance end of the first one of two spaced in-line piler boxes or sheet piling areas 14 and 15. A pile accumulating assembly 16 is provided in the first, or No. 1, piling area 14 which includes a vertical support frame 17 at the entrance end and an associated supporting frame structure 18 on which the forward end of the infeed conveyor assembly 10 is mounted in rearwardly extending cantilever fashion. A terminal section 20, at the entrance end of the infeed conveyor 10, is arranged to pivot on a transverse axis 22 to an upstanding out of the way position for more convenient access to the entrance end of the machine when it is installed in a production line.

A mechanism for arresting forward travel and for guiding the sheets onto the pile P in the No. 1 piling area 14 is indicated at 24 (FIGS. 1 to 5) which forms a part of the pile accumulating assembly 16. The end stop and side guide mechanism 24 is carried on the upright portion 25 of the frame structure 17 and extends in cantilever fashion over the pile supporting lift platform 26 in the area 14. The pile forming and supporting mechanism in the No. 2 piling area 15 substantially duplicates the pile forming and supporting mechanism in the No. 1 piling area and the same numerals primed will be employed to identify those elements in the No. 2 piling area which correspond to like elements in the No. 1 piling area. In the No. 2 piling area there is provided a pile accumulating assembly 16' which is mounted on the upstanding portion 25' of the supporting frame structure 17'. The pile forming assembly 16' has an end stop and side guide mechanism 24' for arresting the forward travel and for guiding the sheets downwardly onto a pile on the pile receiving or lift platform 26' of the assembly 16'. A conveyor assembly 27, which is of a construction similar to infeed conveyor 10, is supported on the frame structure 18' at the top of the upstanding frame structure 25' of the assembly 16' and is contilevered so as to extend rearwardly of the frame structure 18' and in overlying relation above the pile accumulating assembly 16 in the piling area 14. The conveyor assembly 27 serves as a feed conveyor for the No. 2 piling area.

The apparatus includes a classifying arrangement which enables sheets advanced to the classifying area 12, on the infeed conveyor 10, to be divided, so as to be piled in separate piles in the two piling areas 14 and 15. An overhead magnetic conveyor assembly 30 (FIGS. 1, 2, 9, 12 and 13) is supported above the classifying area 12, with the entrance end 32 overlying the infeed conveyor 10 as it approaches the entrance to the first or No. 1 piling area 14. The exit end 33 of the conveyor assembly 30 overlies the receiving end of the conveyor 27 so that sheets advanced on the bottom face of the overhead magnetic conveyor assembly 30 will be delivered to the top surface of the belt conveyor 27 and forwarded to the second or No. 2 piling area 15.

The infeed conveyor 10 is mounted between parallel side support plates 35 and 36 (FIG. 1) which are upstanding from the support frame 18. It comprises a wide, flat endless belt 37 on the top surface of the top run of which the successive sheets are fed from the supply source. The belt 37 is carried on the receiving end of the conveyor 10 on a cross roller 38 which is journaled in pivotally mounted extensions 35' and 36' of the side frame plates 35 and 36. The top run of belt 37 advances in a relatively horizontal plane to cross roller 40 and then in a downwardly inclined plane to the cross roller 42 which is at a lower elevation and journaled between the side frame support plates 35 and 36 above the entrance to the piling area 14. On the return run the belt 37 passes over the cross roller 43 and around a driven cross roller 44 to a tension adjusting roller 45 which is journaled in horizontally sliding bearing blocks of a conventional tension adjusting mechanism 47. The entrance end portion 20 of the conveyor 10 includes a generally rectangular end frame 48 which is mounted to swing about the pivot axis 22 of the cross bar 50. The cross bar 50 carries on its one end a worm gear 52 in engagement with a worm gear 53 which is mounted on a vertical shaft 54. The shaft 54 is journaled in a bracket 55 on the side frame plate 35 at the one end of a cross brace 56 and is manually turnable, by a suitable tool, to swing the frame 48 between a horizontal, operative position and an upstanding inoperative position. The top run of the belt 37 is supported on either side of the cross brace 56 by additional cross rollers 57, 57'. The roller 44 which drives the belt 37 has a pulley 58 (FIG. 1) secured on the one end of its mounting shaft and a drive belt 60 runs to the drive pulley 62 on the motor 63 which is mounted on a laterally extending motor support bracket 64. A chain drive may be employed, if desired.

Figure 10:
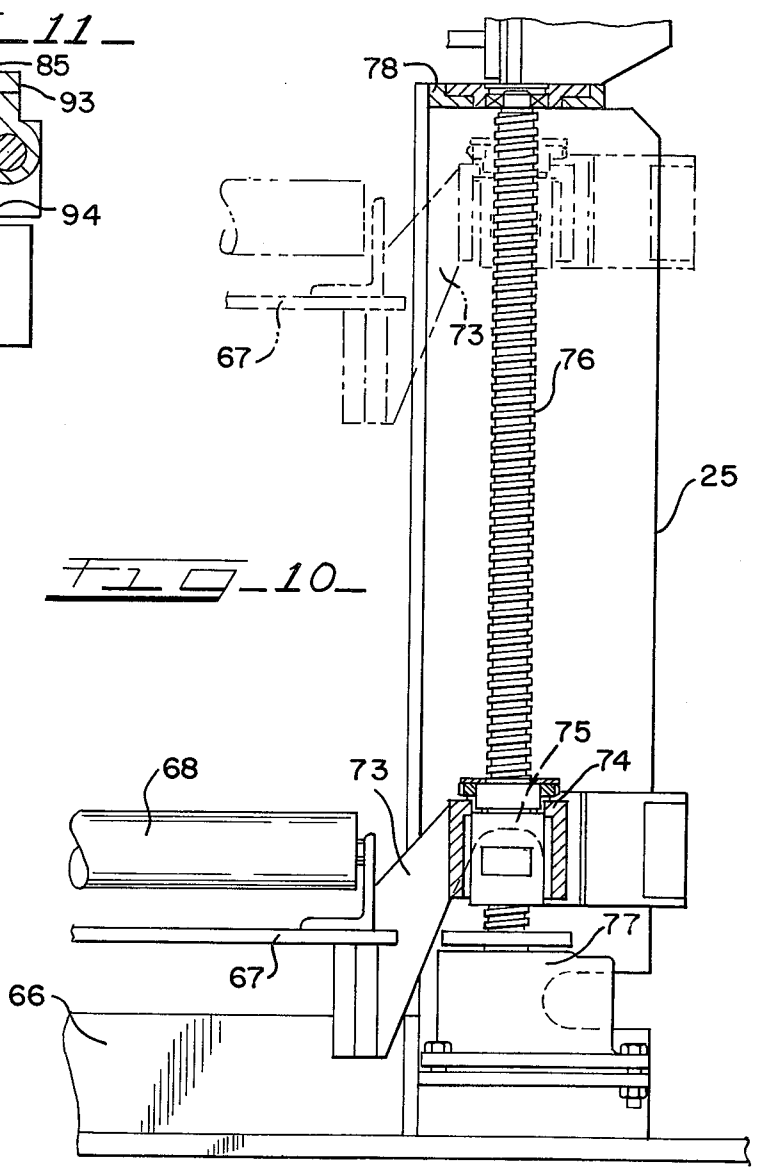
FIG. 10 is a vertical sectional view taken on the line 10—10 of FIG. 9.

The pile accumulating assembly 16 (FIG. 2) in the first, or No. 1, piling area 14, has a scissors-type pile supporting or hoist arrangement which may be constructed as disclosed in my U.S. Pat. No. 3,727,780 to which reference is made for details not hereinafter described. It has a lift platform assembly 26 mounted on scissors-like arm assemblies 65 which collapse or fold when the platform assembly 26 is moved to its lowermost position on the base frame portion 66. The base frame 66 (FIGS. 2 and 9) is disposed horizontally and extends from the upright frame portion 25. The platform assembly 26 comprises a rectangular frame 67 in which are mounted a plurality of rollers 68 (FIGS. 3 and 9) with sprocket and chain drive connections 70 and a drive motor 71. The driven roller arrangement provides a bed or table for supporting the pile on a skid or directly on the rollers 68. A roller conveyor 72 may be provided for cooperation with the driven rollers 68 in moving the pile out of the piling area and in moving an empty skid, when employed, onto the pile supporting rollers 68. The hoist frame 67 has a hook-shaped bracket 73 (FIG. 10) with the hook end riding on a nut housing 74 which encloses a nut 75 carried on a vertically disposed screw 76 which is supported for rotation in the transverse center of the upright frame portion 25. The screw 76 extends upwardly of a right angle drive unit 77 with its upper end journaled in a cross plate 78. The screw 76 is driven by motor 80 (FIG. 9) which has an output drive belt 81 extending to a pulley 82 on a cross shaft 83 which is connected to the right angle drive unit 77 through a coupling 84. The hoist or lift assembly 26 is raised initially to an upper level to receive the first sheets and is lowered as the sheets accumulate in a pile on the platform.

The sheet guiding mechanism 24 is incorporated in and is supported by the hoist assembly structure. A side guide adjusting screw housing 85 (FIGS. 3 and 11) extends transversely of the machine at the top of the upright hoist assembly frame structure 25 and is supported on the frame top plate 78. An adjusting screw 86 is journaled in the housing 85 which has right and left hand threaded end portions and which is rotated by hand wheel 87 secured at one end of the housing 85 so as to adjust the side guide and end stop assemblies 90 and 90' toward and from each other in order to stop the forward movement of the sheets as they are delivered by the conveyor 10 to the piling area 14 (FIG. 2) and to center the sheets laterally on the pile accumulating platform assembly 16, and guide them onto the pile P. The assemblies 90, 90' are mounted for lateral adjustment on opposite sides of the lift assembly and on each of these there is adjustably mounted an end stop mechanism 92, 92' which end stop mechanisms are adapted to be positioned to limit the forward movement of the sheets as they are advanced over the leading end of the infeed conveyor 10. The side guide assemblies 90, 90' are supported in cantilever fashion on carriage forming brackets 93, 93' which brackets are slidably mounted on the housing 85 in which the adjusting screw 86 is journaled. The brackets 93, 93' each encircle the screw housing 85 and each has a portion extending through a slot 94 (FIG. 11) in the housing 85 for connection with a nut 95, 95'. The nuts 95, 95' ride on right and left hand threaded end portions of the side guide adjusting shaft 86 and move the associated brackets 93, 93' when the hand wheel 87 is turned. The side guide and end stop structures 90, 92 and 90', 92' are identical except for being right and left hand and only one will be described in detail, like parts on the other being indicated by the same numerals primed.

Figure 8:
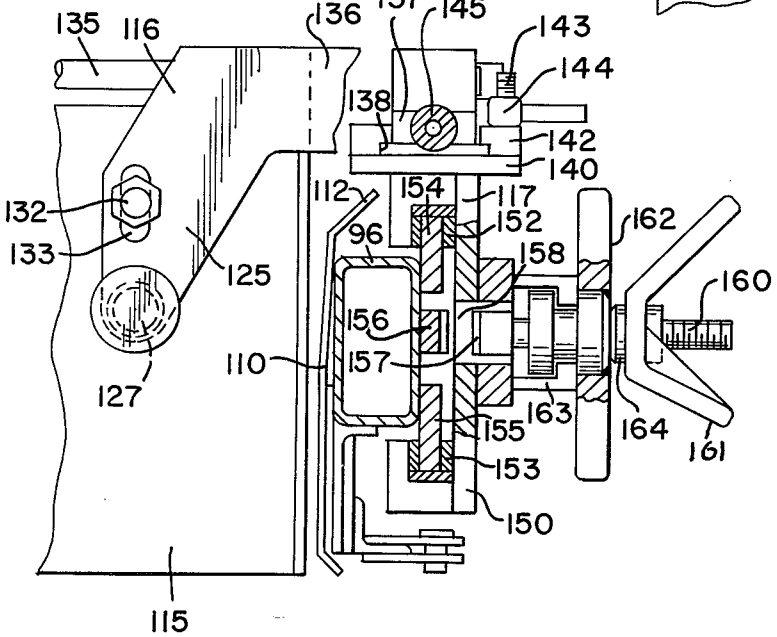
FIG. 8 is a partial elevational, partial sectional view taken on the line 8—8 of FIG. 7.
Figure 13:
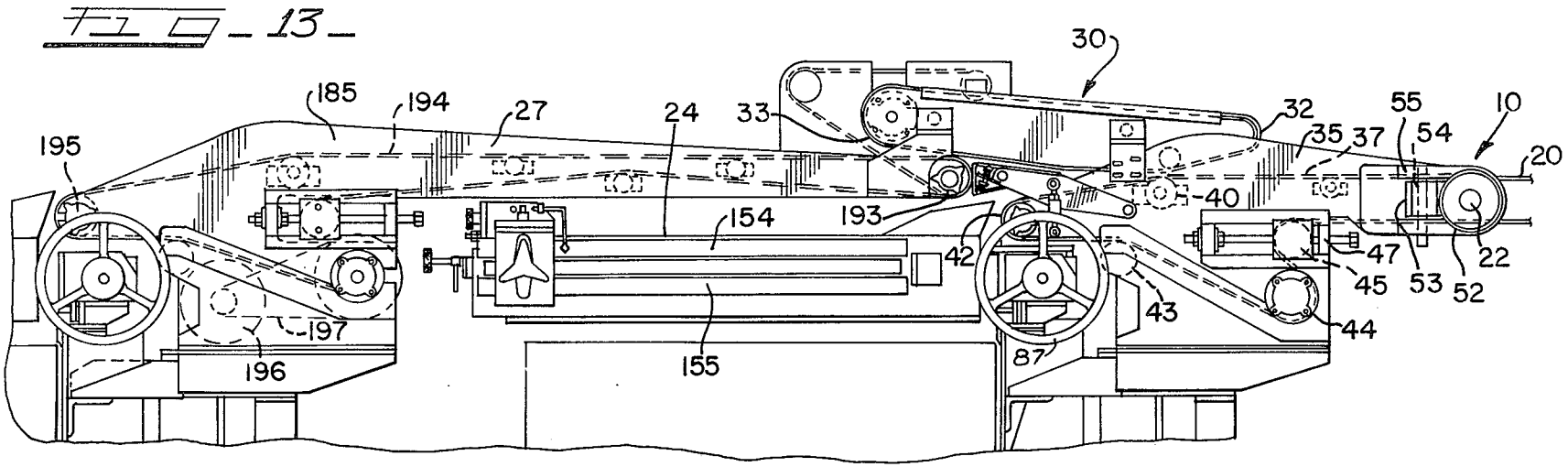
FIG. 13 is a partial side elevational view, showing portions of the apparatus which is shown in FIG. 2, to a larger scale.
Figure 7:
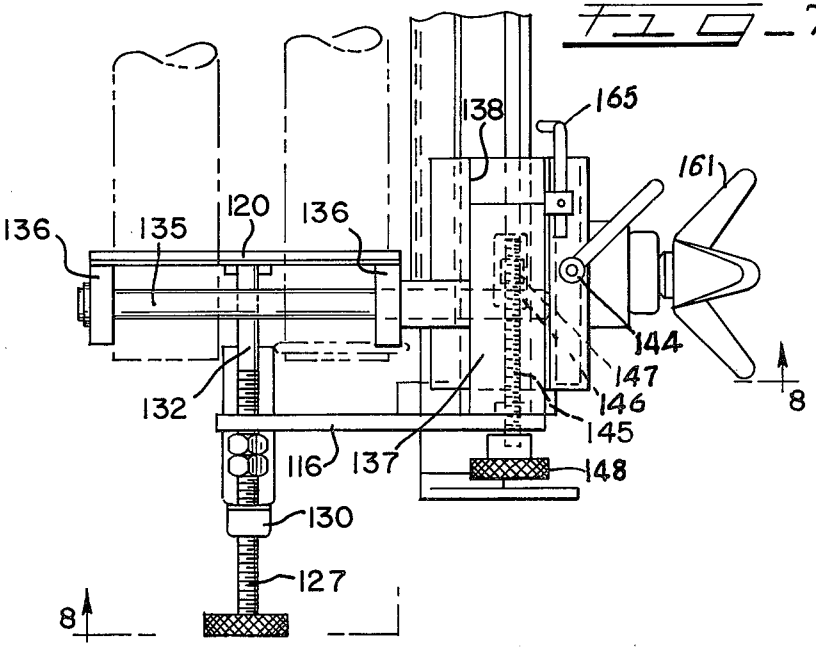
FIG. 7 is a plan view taken on the line 7—7 of FIG. 5, to a larger scale.

The guide assembly 90 (FIGS. 3 to 8) comprises an elongate tubular member 96 (FIG. 8) of generally rectangular cross section with one end swingably mounted on the support bracket 93 by means of a vertical pin 97 (FIGS. 3, 4 and 11) extending between top and bottom bracket plates 98 and 100. The bracket 93 has a vertically disposed plate member 102 with the lower margin riding on a bearing plate 103 on the opposed face of the vertical plate 104 which forms part of housing 85. An extensible or adjustable brace rod or brace bar 105 has one end pivoted at 106 on a bracket 107 secured on the outer face of the member 96. The other end is pivoted on a vertical pin 108 which extends between the bracket plates 98 and 100. The pin 108 is disposed in spaced relation to the pivot pin 97 and enables the guide assembly 90 to be swung laterally in a horizontal plane and to be properly adjusted to a position for engagement by the side edges of the sheets and braced. The hollow beam forming guide member 96 has a guide plate 110 secured on its inner face which extends in a vertical plane and which has an outwardly slanted top edge portion 112. At its trailing end, adjacent the support bracket 93, there is an upward extension 113 of the sheet edge guide plate 110 with an outwardly inclined top portion 114 to insure that the trailing ends of the sheets will be guided onto the pile and not hang up on the top of the side guide structure.

The end stop mechanism 92 (FIGS. 3 to 8) which is carried on the side guide beam member 96 is mounted thereon so as to be adjustably positioned according to the length of the sheets being piled. It comprises a bumper plate assembly 115 (FIGS. 3 and 5 to 8) mounted on a bracket arm 116 extending inwardly of the side guide beam 96 from a supporting carriage structure 117 which is carried on the beam member 96. The assembly 115 includes a bumper plate 118 (FIG. 6), disposed in a vertical plane, and having on its sheet engaging face a suitable sheet edge protecting pad 120, of rubber, Neoprene, or similar material. The plate 118 is spring backed so as to be cushioned for horizontal movement in the direction of advance of the sheets. A pin 122 extends from the leading or forward face of the plate 118 and receives one end of a cushion forming spring 123 which extends into a tubular housing 124 secured on the lower end of a depending portion 125 of the bracket 116. The end of the spring 123 is seated on a headed pin 126 which is slidable in the housing 124. A manually rotatable adjusting screw 127 is mounted in threaded connection with a plug 128 in the end of the tubular spring housing 124 so that the end bears on the headed pin 126. The adjusting screw 127 is provided with a manually adjustable locking nut 130 enabling the pressure on the spring to be adjusted and locked in the desired adjustment. A guide rod 132 extends from the forward face of the bumper plate 118 above the spring 123 and in parallel relation with the long axis of the latter. The rod 132 extends through a vertical slot 133 in the bracket plate portion 125 and has a threaded end portion with nuts 134 thereon so as to adjustably limit the return position of the bumper plate 118. The bumper plate 118 is swingably mounted at its top edge on a small cross shaft or rod 135 (FIGS. 7 and 8) by means of a pair of spaced bearing ears 136. The shaft 135 extends to a slide block 137 (FIG. 8) which is slidably mounted in a guideway 138 in the top face of a top plate 140 on the carriage 117. One side guide member 142 at the outer side of the guideway 138 is mounted on an upstanding threaded pin 143 having a manually operable nut 144 which may be turned down to clamp the slide block 137 in position. The bracket plate 116 extends laterally to a connection with the forward face of the slide block 137 and a threaded rod 145 is journaled at one end in plate 116 which extends in a channel 146 in block 137 for threaded engagement in a nut forming lug 147 upstanding from the top plate 140 of the carriage 117 to enable fine adjustment of the bumper relative to the carriage position by rotation of knob 148 on the rod 145.

The carriage 117 (FIGS. 4, 7 and 8) for the end stop mechanism 92 comprises a vertically disposed plate member 150 with vertically spaced, parallel top and bottom channel members 152, 153 mounted on the inner face which receive and ride on the top and bottom margins of guideway forming plate members 154 and 155. The guideway forming members 154 and 155 are secured on the outer face of the beam member 96 (FIGS. 4 and 8) so as to enable the carriage 117 and the end stop assembly 115 to be slidably adjusted along the length of the beam 96. A locking rack 156 extends along the beam 96 between the guideway forming plate members 154, 155 and provision is made for locking the carriage 117 in adjusted position on the beam by means of a gear rack lock device 157 which operates in an aperture 158 in the vertical plate 150 and is mounted on the end of a threaded pin 160. The pin 160 is movable axially, by rotation of member 161, relative to the bracket assembly or housing 162 into and out of locking position, with a split nut 163 and lock nut assembly 164. A finer adjustment of the position of the bumper pad asembly 115 may be had by rotation of the knob 148 which moves the assembly 115 relative to the carriage 117. The assembly 92 may carry a pointer 165 for cooperation with a scale 166 on the beam 96 for facilitating accurate positioning of the assembly 115. An angle member 167 on the outside face of beam 96 forms a limit stop for the carriage 117. The mounting of the bumper plate 118 permits sufficient movement of the same in the directions necessary to cushion the impact when an oncoming sheet edge strikes the pad 120.

The rearward movement of the sheet resulting from impact with the end stop bumper assemblies 92, 92' is limited by a rear bumper member 170 (FIGS. 3, 5 and 9) which is mounted on the forward face of the screw housing 85 with a sheet edge engaging face in a vertical plane. To cushion the downward movement of the sheets onto the stack or pile it may be desirable to provide for feeding air beneath the successive sheets. For such purpose, in the form shown, an air box 172 is mounted back of the member 170 having a discharge conduit 173 running to a slot 174 in the bumper member 170. With the box 172 connected to a suitable air blower, or the like, air can be fed beneath the successive sheets, as they are deposited and drop onto the pile, so as to cushion the fall of the sheets into the pile.

The overhead conveyor assembly 30 (FIGS. 1, 2, 9, 12 and 13) which is arranged in overlying relation with the forward portion of the infeed conveyor 10, cooperates with the conveyor 27 in feeding selected sheets to the No. 2 piling area. The conveyor 30 comprises two side-by-side, wide belt type conveyor rail unit assemblies 180, 180', of identical construction. The assemblies 180, 180' are mounted between laterally spaced, side frame plates 181, 181' and are supported, at the rearward or trailing end, by bracket members 182, 182'. The bracket members 182, 182' extend upwardly of the side frame plates 35, 36 at opposite ends of a rail support bar or beam 183. At the forward or leading end the assembly 30 is supported from the trailing end of conveyor assembly 27 by means of bracket members 184, 184' which extend upwardly of the side frame members 185, 185' of the conveyor assembly 27, at opposite ends of a forward rail support bar or beam 186. The magnetic conveyor rail units may be the broad belt type, such as, disclosed in U.S. Pat. No. 3,782,529 granted Jan. 1, 1974. The rail units 180, 180' each comprise an elongate frame structure having supporting rollers 187, 187' at opposite ends thereof on which the belt 188 travels. The belt support roller 187 at the trailing end is in sections so as to permit use of a belt tensioning mounting arrangement indicated at 189. A series of longitudinally spaced magnet assemblies 190 extend along the frame structure of each rail unit, which are separated by belt supporting rollers 192, with the magnets 190 and belt rollers 192 arranged so as to provide the desired path for the bottom run of the belt 188 on which the magnets, when activated, hold the sheets for advance to the conveyor 27. The belt carrying roller 187 is driven to advance the sheets through a drive arrangement connecting it with the driven end roller 193 on the conveyor 27, the latter being driven by the conveyor belt 194 which is supported at the opposite or leading end of the conveyor 27 on the end roller 195. The conveyor end roller 195 is driven by the motor 196 through the drive belt connection 197 in the same manner as the drive for the infeed belt conveyor 10. The drive arrangement for the magnetic conveyor assembly 30 is mounted on a vertically disposed support plate 198 extending upwardly of a side frame plate or bracket plate 184' and comprises chain 200 connecting a sprocket 202, which is at the one end of belt roller 193 on the conveyor assembly 27, with a sprocket 203 at the corresponding end of the belt roller 187 which is part of the magnetic conveyor assembly 30. The drive arrangement includes idler sprocket 204 and the adjustably mounted tension sprocket 205.

A mechanical separator or guide member 206 (FIG. 12) is associated with the conveyors 10, 27 and 30. It is in the form of a cross beam of triangular cross section which is supported in the classifying area 12 between laterally spaced link or arm members 207, 207'. A cross pivot 208 connects the arm members 207, 207' with the beam member 206. An extension plate 210 on the arm 207 extends between a pair of axially aligned and oppositely disposed adjusting screws 212 mounted in brackets on the end of member 206 which enables adjusting of the angle of the top and bottom surfaces of member 206 relative to the opposed surfaces of the conveyor belts. The arms 207, 207' are mounted on a cross pivot 213 extending from the side frame plates 35, 36. Each of the arms 207, 207' is adjustable on the cross pivot 213 by means of a link bar 214 which is extensible and which is mounted at opposite ends of pivots 215 and 216 on the side frame plate and the support arm 207, respectively.

Figure 11:
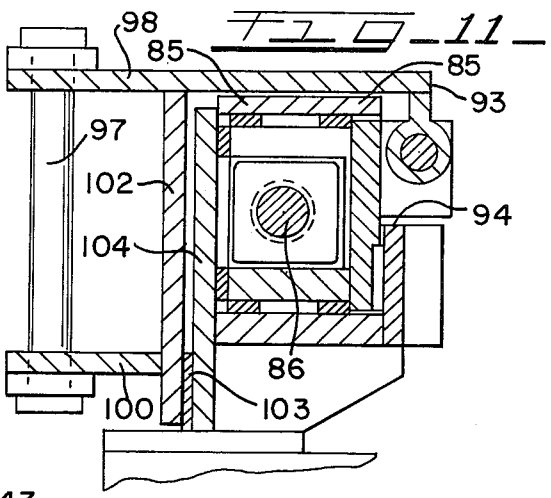
FIG. 11 is a cross sectional view taken on the line 11—11 of FIG. 3 to an enlarged scale.
Figure 6:
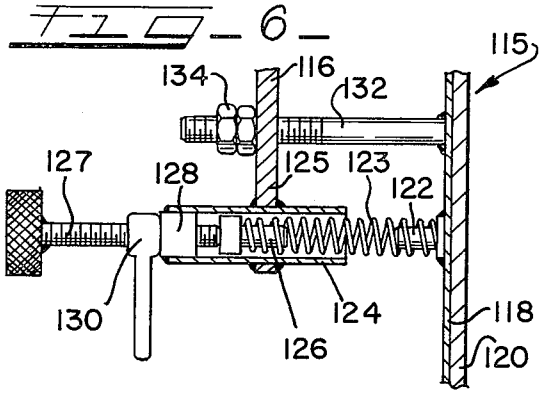
FIG. 6 is a sectional view taken on the line 6—6 of FIG. 5, to a larger scale.
Figure 15:
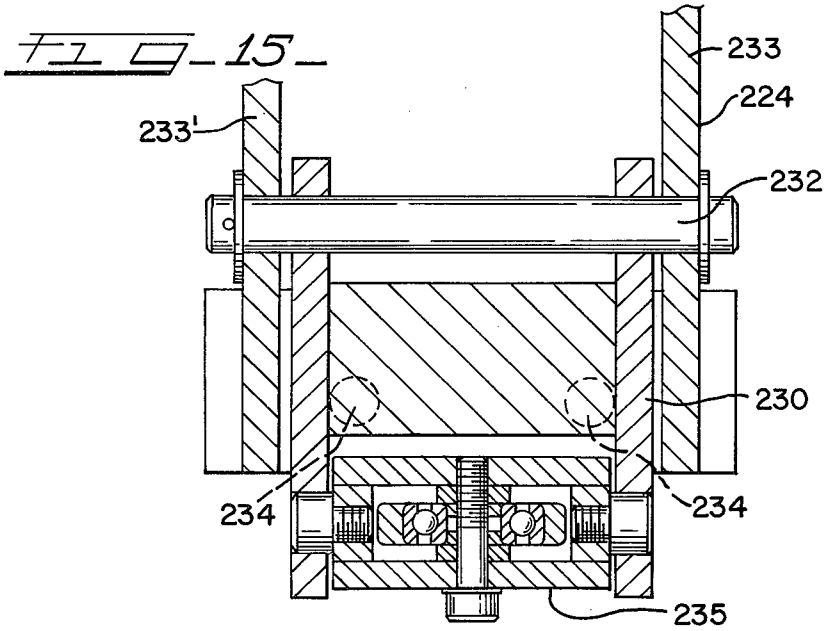
FIG. 15 is a fragmentary sectional view taken on the line 15—15 of FIG. 14, to an enlarged scale.
Figure 14:
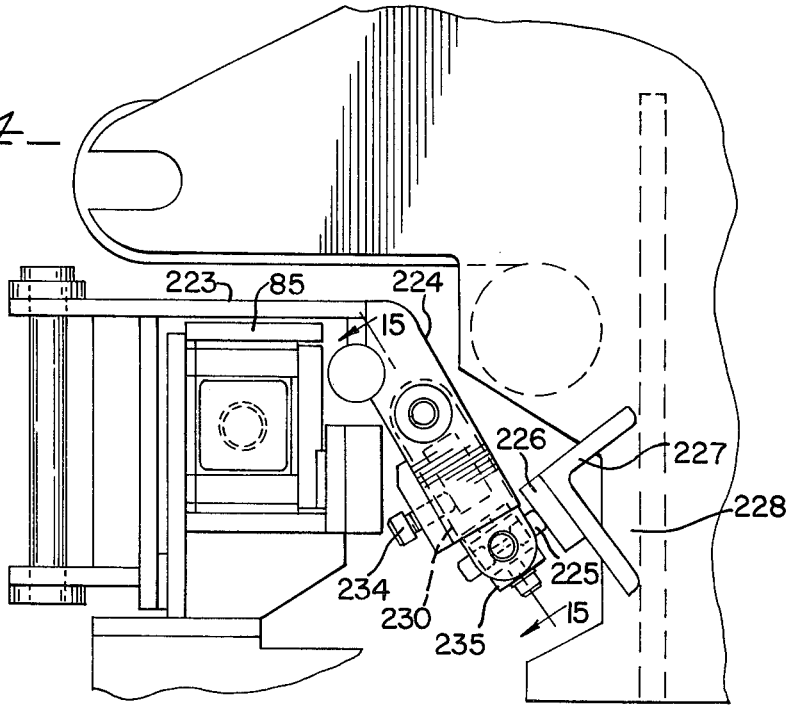
FIG. 14 is a fragmentary side elevational view illustrating a modified side guide supporting structure.

In FIGS. 14 and 15 a modified mounting for the side guide assemblies 90, 90' is illustrated which is adapted to be employed when it is desired to handle sheets of such length as to require relatively long side guides. The carriage 223 which corresponds to carriage 93 in FIGS. 3 and 11 is provided with an extension arm 224 which is attached to the top rearward edge of the carriage and extends at a rearward and downward angle back of the screw housing 85. A bearing member 225 is carried on the end of the arm 224 and bears against the plate member 226 which is secured on the downwardly and rearwardly angled face of an angle member 227. The angle member 227 is secured on the supporting frame portion 228 and extends across the machine. The bearing member 225 which slides with the housing 223, is mounted on the arm 224 so as to keep the bearing or contact faces in line while changes are made in the angle when adjustment of the side guide assembly is made. The arm 224 carries a small rectangular frame 230 on a pivot pin 232 extending between spaced plates 233, 233' which form the arm 224. The frame 230 is adjustably positioned relative to the arm 224 by means of screws 234. At its free end the frame 230 carries a swivel 235 with the bearing member 225 extending generally normal to the plane of the pivoted frame 230 and positioned to engage the bearing plate 226. The arrangement takes the pressure off the screw nut, keeps the screw housing 85 from deflecting and permits the use of longer side guide members.

In using the apparatus the magnets in the overhead conveyor may be controlled by suitable circuitry so as to pick up sheets for delivery to the No. 2 piling area and piling may be under the control of an operator, or, with the inclusion of sheet sensing devices, it may be automatic. Use of the overhead conveyor is, of course, discontinued when it is desired to pile all the sheets in the No. 1 piling area.

When it is desired to increase the number of piles to be formed, additional piling units may be readily added to the machine with an overhead conveyor serving each additional unit and with proper control circuitry.

While the illustrated overhead, classifying conveyor which is illustrated employs electromagnets any other suitable type overhead conveyor may be employed, such as, for example, a vacuum type sheet conveyor where conditions make it desirable. Likewise, the belt conveyors may be magnet or vacuum type or other suitable sheet handling type.

In the piling arrangement shown the successive sheets are delivered to the piling areas over the ends of the feed conveyors (10 and 27) which terminate at the entrance edge of the piling areas (14 and 15). If it is desired to provide for more precise or more accurate piling and to handle the sheets with greater care, overhead magnetic conveyors can be mounted in a suitable manner immediately above the piling areas with control circuitry for the magnets so as to advance the sheets from the infeed conveyor, in each area, and release them for deposit in a more nearly vertical path onto the top of the pile.

I claim:

1. A machine for piling metal sheets comprising a plurality of unitary sheet accumulating mechanisms arranged in aligned relation, each of said accumulating mechanisms comprising a separate supporting frame having a base portion adapted to be disposed horizontally, a vertically movable platform supported on each said frame for receiving thereon a pile of said sheets, an upstanding portion on each said supporting frame and means thereon cooperating with means on the movable platform for guiding the platform in a vertical path between a raised and lowered position, an infeed conveyor supported on each said upstanding frame portion and extending rearwardly thereof in the direction of sheet travel in cantilever arrangement and at an elevation above the raised position of said platform, means for driving said infeed conveyor to deliver sheets to an area above the associated platform, laterally spaced, elongate sheet edge guide members supported on said upstanding frame portion and extending in cantilever arrangement forwardly thereof above said pile receiving platform, end stop mechanism supported on said side guide members and a cooperating back stop member mounted in spaced relation on said upstanding frame portion, and an overhead conveyor disposed above the discharge end of each said infeed conveyors which is operable to pick up sheets delivered by the infeed conveyor and advance said sheets to the infeed conveyor of the next in line sheet accumulating mechanism.

2. A machine for piling metal sheet material in multiple in-line piling areas which comprises a plurality of separate pile accumulating mechanisms each disposed in a piling area and means for advancing sheets for deposit on selected pile accumulating mechanisms, said pile accumulating mechanisms each comprising a separate supporting frame having a base portion adapted to be disposed in a substantially horizontal position and an upstanding frame portion extending upwardly of the side of said base portion which constitutes the entrance side of the pile accumulating mechanism, means extending rearwardly of said side of said base portion for delivering sheets across said upstanding frame portion for deposit in a pile on said pile accumulating mechanism, a pile supporting means mounted on said frame base portion for vertical movement, means for guiding said pile supporting means between raised and lowered position, means for raising and lowering said pile supporting means, and means carried solely on an upper portion of said upstanding frame portion and extending in cantilevered arrangement forwardly over the platform area for arresting the forward movement of sheets delivered to said pile accumulating mechanism and for guiding the edges of the sheets as they are delivered for deposit on the pile supporting means.

3. A machine for piling metal sheet material as set forth in claim 2 wherein said means for advancing sheets for deposit on selected pile accumulating mechanisms comprise an overhead conveyor positioned above the entrance side of a trailing pile accumulating mechanism in said line and operative to pick up selected sheets from the associated sheet delivering means and to advance said selected sheets to the next adjacent pile accumulating mechanism.

4. A machine for piling metal sheets as set forth in claim 3 wherein said overhead conveyor comprises one or more magnetic conveyor rail units disposed with the bottom run thereof spaced in part above the sheet delivering means of said trailing mechanism and in-part above the pile supporting means of said trailing mechanism.

5. In a machine for piling metal sheets as set forth in claim 2, wherein said means for arresting said sheet movement and for guiding the sheets onto a pile on the platform comprises elongate side edge guide members each supported at one end on said upright cross frame portion and extending in cantilever arrangement above said platform and in laterally spaced relation, and end stop mechanism mounted on each said side edge guide member.

6. In a machine for piling metal sheets as set forth in claim 5 wherein said end stop mechanism comprises an end stop pad member, means adjustably mounting each of said pad members on the associated side edge guide member so as to enable piling of sheets of varying length.

7. In a machine for piling metal sheets as set forth in claim 5 wherein said side edge guide members are each mounted at the one end thereof on a carriage, an elongate screw housing extending across said upright frame portion which forms a supporting track for said carriages, an adjusting screw mounted in said housing for rotation, nut means connecting said carriages to oppositely threaded ends of said screw so as to enable lateral adjustment of said side edge guide members.

8. In a machine as set forth in claim 5 wherein each said end stop mechanism comprises a carriage slidably mounted on the associated side edge guide member for adjustment along the length of said side edge guide member and an end stop pad member, said end stop members each being in the form of a stop plate mounted for cushioned swinging movement on a cross rod extending from the associated carriage and wherein a back stop member is mounted on the forward side of said upright cross frame portion in spaced relation to said end stop members for cooperation therewith in guiding the leading and trailing edges of the sheets onto a pile on said platform.

9. In a machine for piling metal sheets a supporting frame comprising a base frame member and an upright cross frame portion extending at one side thereof, platform means for supporting a pile of sheets mounted on said base frame member, means mounting said platform means for vertical movement between a raised and lowered position, conveyor means mounted with a discharge end extending across said upright frame portion for delivering sheets for deposit on said platform means and means for arresting the forward movement of sheets delivered above said platform and for guiding the sheets onto a pile on said platform which means is supported solely on said upright frame portion and extends in cantilevered relation therefrom above said pile supporting platform, said means for arresting said sheet movement and for guiding the sheets comprising elongate side edge guide members supported at one end on said upright cross frame portion and extending in cantilever arrangement above said platform and in laterally spaced relation, and end stop mechanism mounted on said side edge guide members which comprises end stop pad members adjustably mounted on said side edge guide members so as to accommodate sheets of varying length, said side guide carriages having mounted on the rearward sides thereof rearwardly extending arm members with means on the free ends thereof in sliding engagement with a downwardly and rearwardly facing surface of a bearing plate which is mounted on and extends across said upright frame portion so as to brace said carriages against twisting movement on said housing, and said means on the free ends of each of said rearwardly extending arm members comprising a bearing member on a swivel mounting which is carried on the end of a small frame pivotally mounted on the associated arm member.

10. In a machine for piling metal sheets a supporting frame comprising a base frame member and an upright cross frame portion extending at one side thereof, a platform means for supporting a pile of sheets mounted on said base frame member for vertical movement between a raised and lowered position, sheet conveyor means mounted with a discharge end extending across said upright frame portion for delivering sheets for deposit on said platform means and means for arresting the forward movement of sheets delivered above said platform and for guiding the sheets onto a pile on said platform which means for arresting said sheet movement and for guiding the sheets onto a pile on the platform is supported solely on said upright frame portion and extends in cantilevered relation therefrom above said pile supporting platform, said means for arresting said sheet movement and for guiding the sheets onto the platform comprising elongate side edge guide members supported at one end on said upright cross frame portion and extending in cantilever arrangement above said platform and in laterally spaced relation, and end stop mechanism mounted on said side edge guide members, said side edge guide members each being in the form of an elongate beam pivotally mounted at a trailing end thereof on a carriage which is slidably supported for lateral adjustment on a screw housing and having an extensible brace member pivotally connected at one end to the outermost side and intermediate the ends thereof, said brace member extending to a pivotal connection with said carriage which is spaced from the pivotal connection of said beam with said carriage so as to enable angular adjustment of said beam.

11. In a machine for piling metal sheets a supporting frame comprising a base frame member and an upright cross frame portion extending above said base frame member at the entrance side thereof, a platform means for supporting a pile of sheets mounted on said base frame member for vertical movement between a raised and lowered position, drive means for raising and lowering said platform, sheet conveyor means mounted with a discharge end extending across said upright frame portion and above the same for delivering sheets for deposit on said platform and means for arresting the forward movement of sheets delivered above said platform and for guiding the sheets onto a pile on said platform which means for arresting said sheet movement and for guiding the sheets onto a pile on the platform is supported solely on said upright frame portion and extends in cantilevered relation therefrom forwardly above said pile supporting platform, said means for arresting said sheet movement and for guiding the sheets onto a pile on the platform comprising elongate side edge guide members each supported at one end on said upright cross frame portion and extending in cantilever arrangement above said platform and in laterally spaced relation and end stop mechanism mounted on each said side edge guide member, said side guide carriages having mounted on the rearward sides thereof rearwardly extending arm members, means forming a downwardly and rearwardly facing bearing plate surface mounted on and extending across said upright frame portion adjacent said screw housing and means on the free ends of said rearwardly extending arm members positioned in sliding engagement with said bearing plate surface so as to brace said carriages against twisting movement of said housing.

12. In a machine for piling metal sheets, a supporting frame comprising a base frame member and an upright cross frame portion extending above said base frame member at the entrance side thereof, a platform means for supporting a pile of sheets mounted on said base frame member for vertical movement between a raised and lowered position, drive means for raising and lowering said platform, sheet conveyor means mounted with a discharge end extending across said upright frame portion and above the same for delivering sheets for deposit on said platform and means for arresting the forward movement of sheets delivered above said platform and for guiding the sheets onto a pile on said platform which means for arresting said sheet movement and for guiding the sheets onto a pile on the platform is supported solely on said upright frame portion and extends in cantilevered relation therefrom forwardly above said pile supporting platform, said means for arresting said sheet movement and for guiding the sheets onto a pile on the platform comprising elongate side edge guide members each supported at one end on said upright cross frame portion and extending in cantilever arrangement above said platform and in laterally spaced relation, and end stop mechanism mounted on each said side edge guide member, said side edge guide members each being mounted at the one end thereof on a carriage, an elongate screw housing extending across said upright frame portion forming a supporting track for said carriages, an adjusting screw mounted in said housing for rotation, nut means connecting said carriages to oppositely threaded ends of said screw so as to enable lateral adjustment of said side edge guide members, said side edge guide members each being in the form of an elongate beam which is pivotally mounted at a trailing end thereof on the carriage which is slidably supported for lateral adjustment on said screw housing and an extensible brace member pivotally connected at one end to the outermost side of said beam intermediate the ends of said beam and extending to a pivotal connection with said carriage which is spaced from the pivotal connection of said beam with said carriage so as to enable angular adjustment of said beam.

* * * * *